US008257061B2

(12) United States Patent
Ribas, Jr. et al.

(10) Patent No.: US 8,257,061 B2
(45) Date of Patent: Sep. 4, 2012

(54) HERMETIC COMPRESSOR WITH INTERNAL THERMAL INSULATION

(75) Inventors: Fernando Antonio Ribas, Jr., Joinville (BR); Rodrigo Link, Joinville (BR); Dietmar Erich Bernhard Lilie, Joinville (BR); Marcio Luiz Todescat, Joinville (BR)

(73) Assignee: Whirlpool S.A., São Paulo-Sp (BR)

( * ) Notice: Subject to any disclaimer, the term of this patent is extended or adjusted under 35 U.S.C. 154(b) by 878 days.

(21) Appl. No.: 12/094,459

(22) PCT Filed: Dec. 14, 2006

(86) PCT No.: PCT/BR2006/000280

§ 371 (c)(1),
(2), (4) Date: Jun. 27, 2008

(87) PCT Pub. No.: WO2007/068072

PCT Pub. Date: Jun. 21, 2007

(65) Prior Publication Data

US 2008/0260561 A1 Oct. 23, 2008

(30) Foreign Application Priority Data

Dec. 16, 2005 (BR) ..... 10505717

(51) Int. Cl.
*F04B 17/00* (2006.01)

(52) U.S. Cl. ..... 417/415; 417/372; 417/902

(58) Field of Classification Search ..... 417/415, 417/416, 417, 559, 902, 372; 415/177
See application file for complete search history.

(56) References Cited

U.S. PATENT DOCUMENTS

| | | | | |
|---|---|---|---|---|
| 2,382,716 | A | 8/1945 | Herzmark | |
| 3,926,009 | A | 12/1975 | Parker et al. | |
| 4,352,377 | A | 10/1982 | Fritchman | |
| 4,371,319 | A | 2/1983 | Murayama et al. | |
| 5,096,395 | A | 3/1992 | Todescat et al. | |
| 5,816,783 | A * | 10/1998 | Oshima et al. | 417/415 |
| 6,347,523 | B1 | 2/2002 | Barrash et al. | |
| 2001/0047718 | A1 * | 12/2001 | Murdoch | 92/144 |
| 2005/0002811 | A1 * | 1/2005 | Froeslev et al. | 417/559 |
| 2005/0008517 | A1 * | 1/2005 | Iversen et al. | 417/569 |

* cited by examiner

*Primary Examiner* — Charles Freay
*Assistant Examiner* — Todd D Jacobs
(74) *Attorney, Agent, or Firm* — Gifford, Krass, Sprinkle, Anderson & Citkowski, P.C.

(57) ABSTRACT

A hermetic compressor with internal thermal insulation, comprising: a compression cylinder having one end closed by a valve plate provided with a discharge orifice and having a front face against which is mounted a cylinder cover internally defining a discharge chamber; and a spacing duct having one inlet end hermetically mounted to the front face of the valve plate and open to the discharge orifice and an outlet end hermetically mounted to the cylinder cover and open to the interior of the discharge chamber, said spacing duct defining a hermetic fluid communication between the interior of the compression cylinder and the discharge chamber maintaining the cylinder cover spaced from the valve plate and defining, with the latter, an annular plenum around said spacing duct.

15 Claims, 7 Drawing Sheets

HERMETIC COMPRESSOR WITH INTERNAL THERMAL INSULATION

CROSS REFERENCE TO PRIOR APPLICATIONS

This application is the U.S. national phase of International Application No. PCT/BR2006/000280, filed Dec. 14, 2006, which claims priority from Brazilian Patent Application No. PI0505717-5, filed Dec. 16, 2005. The disclosures of both applications are incorporated herein by reference in their entirety. The International Application published in English on Jun. 21, 2007 as WO 2007/068072 under PCT Article 21(2).

FIELD OF THE INVENTION

The present invention refers to a hermetic compressor of the type used in refrigeration appliances, such as refrigerators and freezers, and which allows the thermal insulation of the hot regions inside the compressor that are heated by the heat generated with the compression of gas during the operation of the compressor and, more particularly, of the region of the cylinder cover, in which the gas is discharged.

BACKGROUND OF THE INVENTION

Refrigeration compressors have been object of studies that aim at improving the performance of these compressors. Among the various points of this performance to be improved, one can point out the increase of the amount of refrigerant gas drawn during suction and the reduction of the power required to compress the refrigerant gas. In order to achieve such objectives, it is necessary to reduce the temperature of the refrigerant gas in the suction (increasing its specific mass) and also to reduce the temperature of the compression chamber wall which contacts the refrigerant gas. The development of solutions which promote the reduction of the temperature levels of the compressor and of the flows dissipated by the hot parts thereof is one of the feasible ways to reach these goals.

Hermetic compressors of the type used in refrigeration systems usually comprise, in the interior of a housing, a motor-compressor assembly having a cylinder block in which is defined a cylinder having an end closed by a head and internally defining a discharge chamber in selective fluid communication with a compression chamber defined inside the cylinder and closed by a valve plate provided between the cylinder closed end and the head, said fluid communication being defined through suction and discharge orifices provided in the valve plate and which are selectively and respectively closed by suction and discharge valves, which are usually carried by the valve plate. One of the major causes responsible for heating the internal components of the compressor is its discharge system, which comprises the entire path of the refrigerant gas, from its exhaustion from the compression chamber to the discharge of said refrigerant gas from the inside the compressor. This is because the refrigerant gas reaches the highest temperature levels during its compression inside the cylinder of the motor-compressor assembly, and the heat generated by said compression is dissipated for the other components of the compressor, during the path of the refrigerant gas from the compression chamber inside the cylinder to its discharge from the inside the compressor housing.

One solution to avoid this energy dissipation is to insulate the gas discharge system from the rest of the compressor. By doing this, the extremely hot gas exhausted from the compression chamber will pass through the discharge system without transferring heat to the other components, thereby reducing the temperature levels of the compressor as a whole. Solutions to insulate the discharge system may be found in U.S. Pat. No. 3,926,009, in which the gas discharge tube is defined having a double wall, in order to minimize heat transfer of the gas under compression to the interior of the housing, and in U.S. Pat. No. 4,371,319, in which each of the parts of cylinder cover, discharge muffler and discharge tube is surrounded by a thermal insulating element with the same purpose of minimizing heat transfer of the gas under compression to the interior of the housing disclosed in U.S. Pat. No. 3,926,009. In the vast majority of the refrigeration hermetic compressors, mainly of the reciprocating type, the compressor discharge system comprises a first discharge chamber defined inside the cylinder cover, and located after the valve plate and which receives the gas coming from the compression cylinder. This gas passes subsequently through other chambers before reaching a compressor discharge tube, which leads the compressed refrigerant gas out from the compressor housing to a refrigeration system to which said compressor is usually associated.

Studies have proved that one of the major causes responsible for heating the compression cylinder is the heat flow generated by the gas in the cylinder cover, which heats the valve plate and, by conduction, heats the top of the cylinder block, in the region of the compression chamber of the compression cylinder. The reduction of this heat flow has a positive impact in reducing the temperature of the cylinder and consequently in reducing the compression power.

The known prior art presents different alternatives to make possible a reduction of the heat transfer from the cylinder cover region to regions inside the housing distant therefrom. There are known devices, such as heat exchangers, for example "Stirling" machines, as taught in U.S. Pat. No. 6,347,523; the provision of fins on the heads and the use of an auxiliary air motion system; the use of heat pipes; the use of fluid pumping system using pumps driven by mechanic or electric oscillating motion, among others. However, said known solutions do not minimize the heat transfer between the cylinder cover and the cylinder block, due to the gas discharge from the compression chamber to the discharge chamber.

OBJECTIVES OF THE INVENTION

Thus, it is an object of the present invention to provide a hermetic compressor with internal thermal insulation, particularly in the cylinder block, which increases the compression efficiency, increasing the gas suction capacity of the compressor and reducing the power required for compressing said gas.

It is also an object of the present invention to provide a compressor as mentioned above, which reduces the temperature in the region of the cylinder block adjacent to the region of the cylinder cover mounted thereto.

It is a further object of the present invention to provide a hermetic compressor as mentioned above, which presents a reduced thermal profile.

SUMMARY OF THE INVENTION

These and other objectives are achieved through a hermetic compressor with internal thermal insulation, comprising: a housing internally carrying a cylinder block in which is defined a compression cylinder, having one end closed by a valve plate provided with a discharge orifice and a suction orifice, said valve plate having a front face against which is mounted a cylinder cover internally defining a discharge chamber, said hermetic compressor further comprising a spacing duct having one inlet end hermetically mounted to the front face of the valve plate and open to the discharge orifice of the valve plate, external to the suction orifice thereof, and an outlet end hermetically mounted to the cylinder cover and open to the interior of the discharge chamber, with the inlet end of the spacing duct presenting a cross-section area at least equal to that of the discharge orifice, said spacing duct defining a hermetic fluid communication between the interior of the compression cylinder and the discharge chamber through the discharge orifice, said spacing duct maintaining the cylinder cover spaced from the valve plate and defining, with the latter, an annular plenum around said spacing duct.

The present invention, as described above, provides the insulation for the heat flow between the gas in the cylinder cover and the compressor block. In one construction of the present invention, this insulation is effected by the provision of a gap between the valve plate and the cylinder cover, generating a gas volume which allows reducing the transfer of heat from the hot discharge gas to the valve plate and, consequently by conduction, to the top of the compression cylinder of the compressor.

BRIEF DESCRIPTION OF THE DRAWINGS

The invention will be described below with reference being made to the attached drawings, given by way of example of the possible embodiments of the invention and in which.

DETAILED DESCRIPTION OF THE ILLUSTRATED EMBODIMENTS

Figure 1:
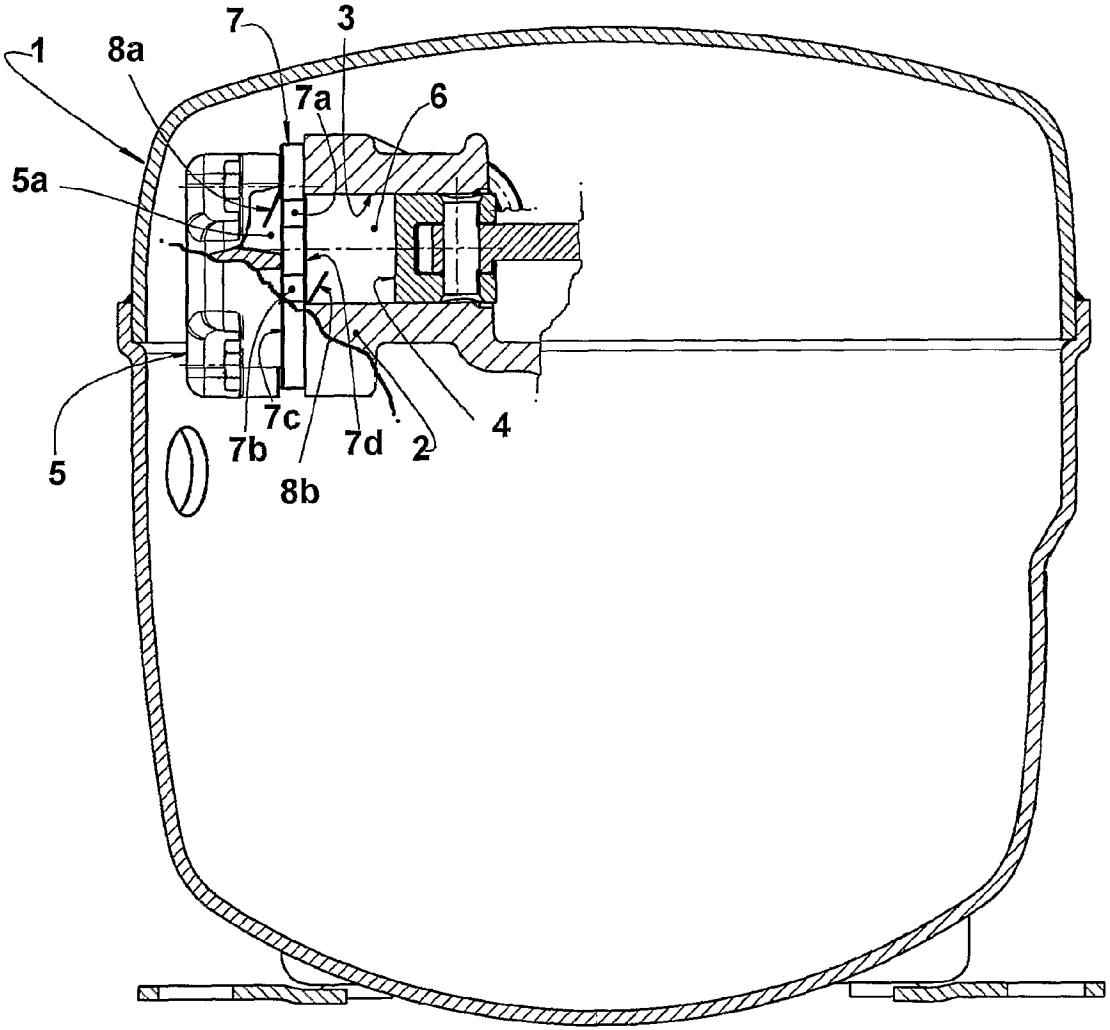
FIG. 1 PRIOR ART
FIG. 1 represents a schematic vertical sectional partial view of a hermetic compressor illustrating the region of the cylinder cover built according to the prior art.

The internal thermal insulation system for a hermetic compressor of the present invention is designed to be applied to a reciprocating compressor driven by a linear or conventional motor of the type used in refrigeration systems of refrigeration appliances, said compressor being, for example, of the type illustrated in FIG. 1 and comprising, inside a hermetic housing 1, a motor-compressor assembly having a cylinder block 2, in which is defined a compression cylinder 3 lodging, in one end, a piston 4 for compressing a refrigerant fluid and having an opposite end closed by a cylinder cover 5 or head, internally defining a discharge chamber 5*a* which maintains selective fluid communication with a compression chamber 6 defined inside the compression cylinder 3, between a top portion of piston 4 and a valve plate 7 provided between the opposite end of the compression cylinder 3 and the cylinder cover 5, said valve plate 7 having a front face 7*c*, against which is mounted the cylinder cover 5, and a rear face 7*d*, facing cylinder block 2.

The fluid communication between the interior of the compression chamber 6 and the discharge chamber 5*a* of the cylinder cover 5 is defined by a discharge orifice 7*a* provided in the valve plate 7 and closed by a respective discharge valve 8*a*, usually carried by the valve plate 7.

The gas drawn by the compressor comes from a suction line (not illustrated) of the refrigeration system to which the compressor is coupled, being selectively drawn, by operation of piston 4, during its suction cycle, to the inside of the compression chamber 6 through a suction orifice 7*b*, due to the selective opening of a suction valve 8*b* mounted on the valve plate 7, said gas being subsequently compressed until its discharge to the discharge chamber 5*a* in the cylinder cover 5. Heat is generated during compression of the refrigerant gas, as described above.

Figure 2:
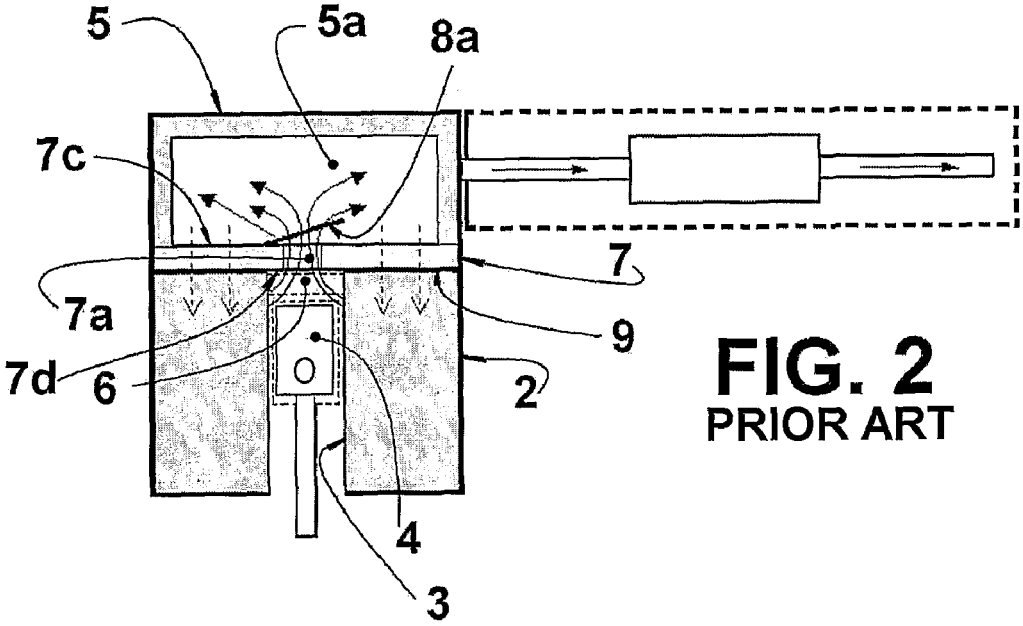
FIG. 2 PRIOR ART
FIG. 2 represents a schematic cross-sectional partial view of the cylinder block illustrated in FIG. 1, indicating, by means of solid arrows, the path of a refrigerant gas under compression being discharged inside the cylinder cover, and by means of dashed arrows, part of the heat propagation direction from the discharge chamber in the cylinder cover.

FIG. 2 is a schematic view of the compression cylinder and of part of the discharge system generally used in reciprocating compressors, according to the prior art. The gas is compressed inside the compression chamber 6 by piston 4, until the opening of the discharge valve 8*a*, allowing the discharge of the gas at high temperature and pressure through the discharge orifice 7*a* into the discharge chamber 5*a* of the cylinder cover 5 (as indicated by the solid arrows in said FIG. 2), and thence to the remaining part of the discharge system of the compressor. With the compression process, part of the thermal energy of the gas inside the discharge chamber 5*a*, generated by the compression, returns to the cylinder block 2, as shown by the dashed arrows in FIG. 2, resulting in an increase of the temperature of the cylinder, even considering the use of a sealing gasket 9, which usually has thermal insulation properties, said sealing gasket 9 being located between the valve plate 7 and the cylinder block 2.

The present solution provides a thermal insulation inside the housing 1, which allows reducing the heat flow of the hot gas from inside the discharge chamber 5*a* to the region of the cylinder block 2, which has a positive impact in reducing the temperature of the cylinder block 2 and, consequently, in reducing the compression power and losses due to gas overheat.

The thermal insulation of the present invention is achieved by providing the hermetic compressor with a spacing duct 20 having an inlet end 21, open to the discharge orifice 7*a* of the valve plate 7 and external to the suction orifice 7*b* thereon, and an outlet end 22, open to the interior of the discharge chamber 11, said spacing duct 20 defining a hermetic fluid communication between the interior of the compression cylinder 3 and the discharge chamber 11, and keeping the cylinder cover 10 spaced from the valve plate 7 by a value calculated so as to reduce the heat transfer from the gas in the discharge chamber to the valve plate 7.

In a constructive option of the present invention, the spacing duct 20 has its inlet end 21 hermetically mounted to the front face 7*c* of the valve plate 7 and open to the discharge orifice 7*a*, and its outlet end 22, for example, being axially aligned with the inlet end 21 and hermetically mounted to the cylinder cover 10 and open to the interior of the discharge chamber 11, the inlet end 21 of the spacing duct 20 having a cross-section area at least equal to that of the discharge orifice 7*a*, said spacing duct 20 defining the fluid communication between the interior of the compression cylinder 3 and the discharge chamber 11, through the discharge orifice 7*a*.

According to the present invention, the discharge orifice 7*a* of the valve plate 7 is contained inside the cross-section contour of the inlet end 21 of the spacing duct 20, said cross-section circumscribing, more particularly, the contour of the discharge valve 8*a*. In a non-illustrated embodiment, the contour of the inlet end 21 of the spacing duct 20 may be of any type, matching or not the one of the outlet end 22 of the spacing duct 20, also being lower or laterally displaced in relation to that of the discharge valve 8*a*, as long as it does not interfere with the gas flow through the discharge orifice 7*a*.

The illustrated embodiments for the spacing duct 20 present the latter with a constant cross-section along its length, including the inlet end 21 and outlet end 22 thereof. However, it should be understood that within the concept presented herein, the spacing duct 20 may have a constant cross-section between the inlet and outlet ends 21, 22 thereof, which cross-section can be or not distinct from that of said inlet end 21 and outlet end 22. Said inlet end 21 and outlet end 22 may, for example, have the same cross section, although this is not mandatory.

Figure 3:
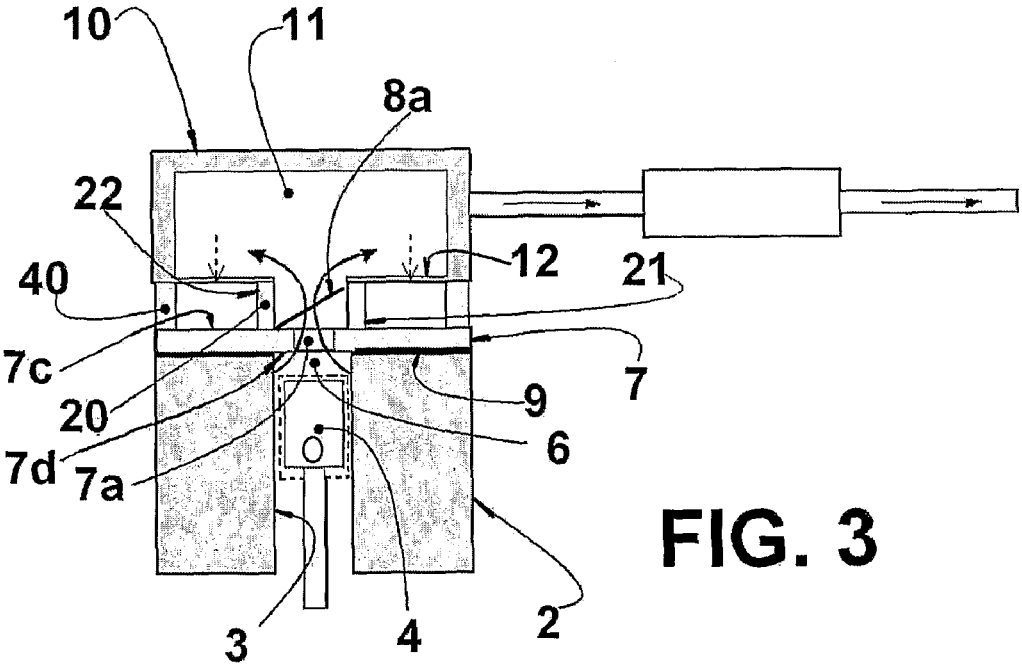
FIG. 3 represents in a schematic view similar to that of FIG. 2, a first constructive option for the internal thermal insulation system of the compressor, according to the present invention.
Figure 4:
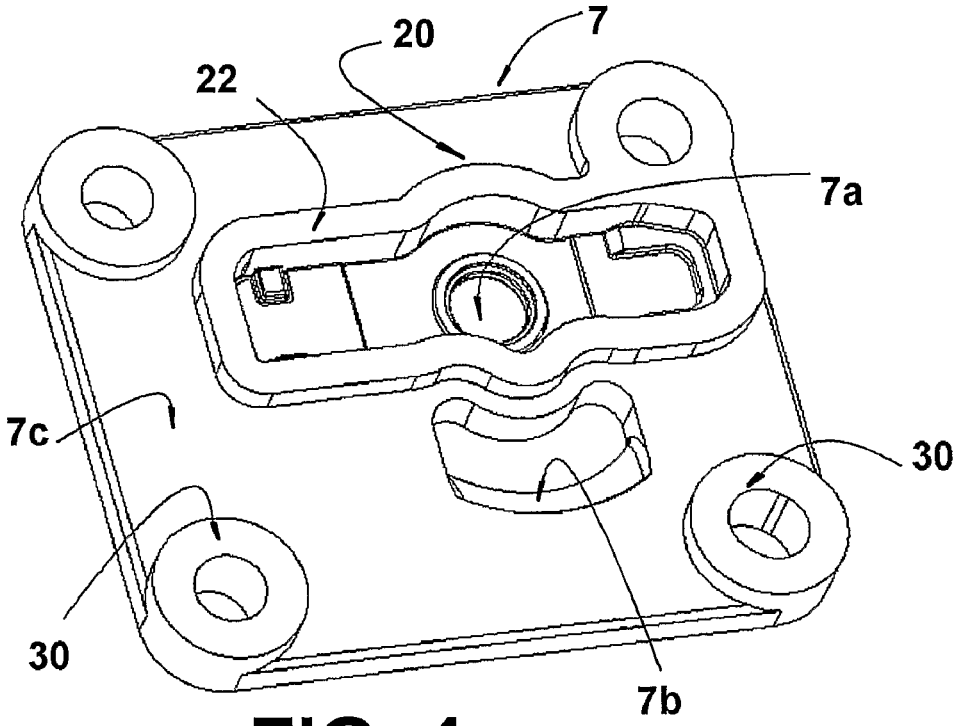
FIG. 4 presents one way of carrying out the present invention, as illustrated in FIG. 3 and in which the spacing duct is carried by the valve plate.
Figure 5:
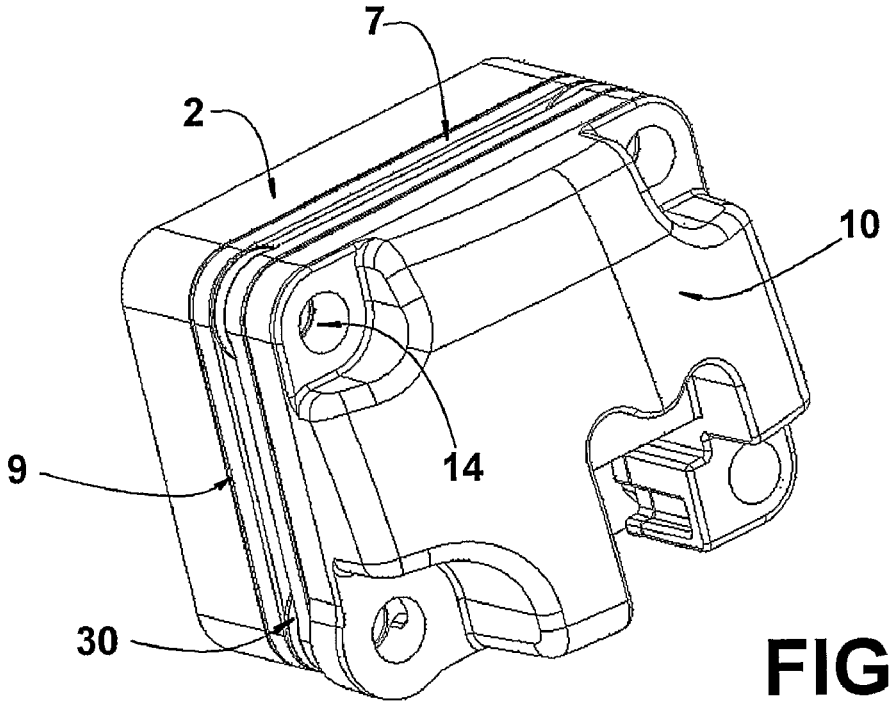
FIG. 5 is a perspective view of a cylinder cover mounted to a valve plate built according to the present invention and as illustrated in FIG. 4.

According to one way of carrying out the present invention, as illustrated in FIGS. 3 to 5, the valve plate 7 carries, for example incorporating in a single piece, the inlet end 21 of the spacing duct 20, said incorporation being obtained during the formation of the valve plate 7 or afterwards by means of an adequate fixation means, such as, for example, welding, glue, etc.

Figure 6:
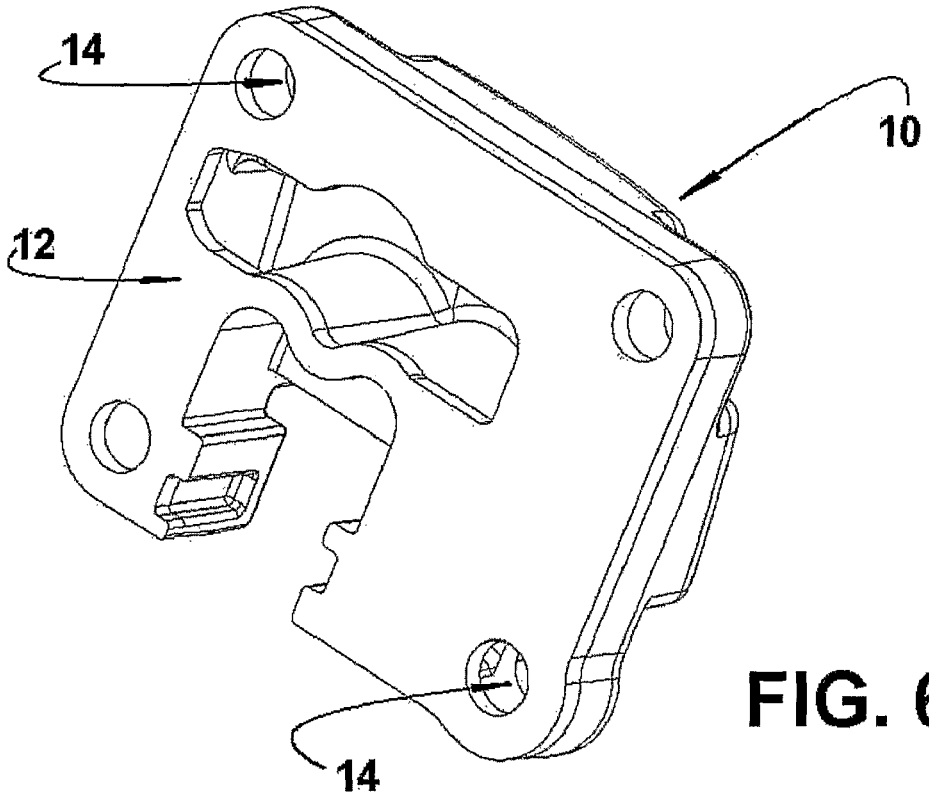
FIG. 6 is a perspective view of a cylinder cover construction having the front face thereof shaped to be mounted to a valve plate of the type illustrated in FIG. 4.

In this construction, the cylinder cover 10 carries, incorporating in a single piece, as illustrated in FIG. 6, or securing by conventional means, as mentioned above, a front wall 12 for closing said cylinder cover 10 and which is seated against the outlet end 22 of the spacing duct 20, with the interposition of at least one sealing gasket 9 therebetween, which is made for example of a thermal insulating material, in order to minimize the transfer by conduction of part of the heat flow through the spacing duct 20.

According to the illustration in FIG. 4, between the valve plate 7 and cylinder cover 10 are also provided tubular fixation spacers 30, each being aligned with a fixation orifice 7*e* defined on the valve plate and with a corresponding fixation hole 14 provided on the cylinder block 2, particularly on the cylinder cover 10, to allow a fixation element, such as a screw (not illustrated) to pass, securing the cylinder cover 10 to the cylinder block 2.

In another way of carrying out the invention, as illustrated in FIGS. 7 to 13, the cylinder cover 10 carries, for example, incorporated therein in a single piece during the formation thereof or by fixation through adequate means, such as welding, glue, etc., the outlet end 22 of the spacing duct 20. In this constructive option, the spacing duct 20 carries, in the region of its outlet end 22, a peripheral flange 23 fixed against the cylinder cover 10 and defining a wall portion of the latter.

According to the illustrations, the spacing duct 20 is provided orthogonal to a plane containing the front face 7*c* of the valve plate 7, being also orthogonal to the wall portion of the cylinder cover 10 defined by the peripheral flange 23.

In the constructive embodiment illustrated in FIGS. 7 to 10, the peripheral flange 23 is incorporated in a single piece to the spacing duct 20 during the formation thereof, defining part or the whole of the front face 12 of the cylinder cover 10.

Figure 7:
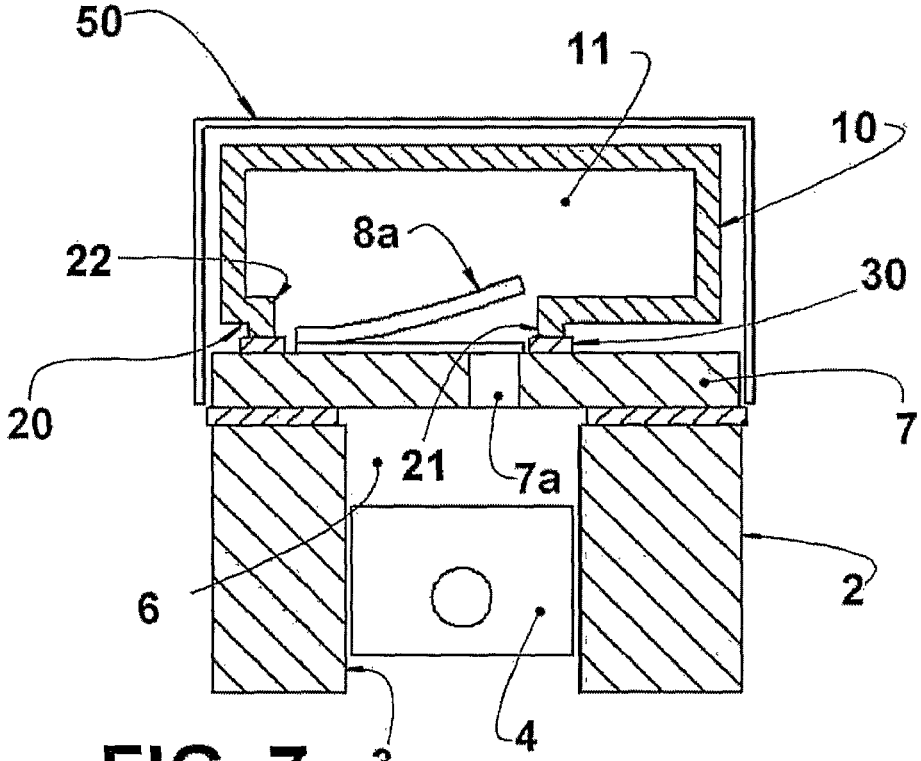
FIG. 7 represents, in a schematic view similar to that of FIG. 3, a second constructive option for the internal thermal insulation system of the compressor, according to the present invention.
Figure 8:
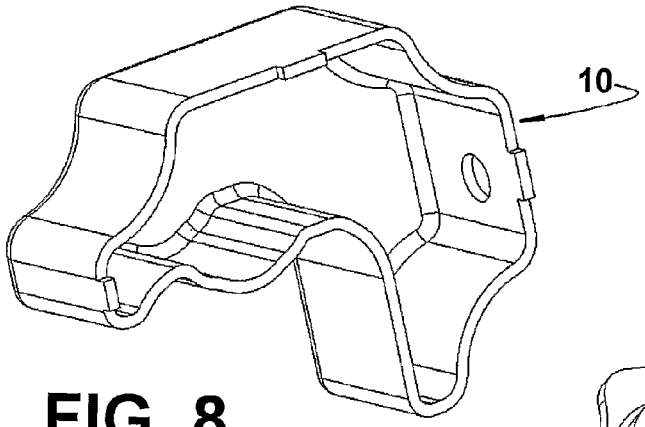
FIGS. 8 and 8*a* are, respectively, perspective views of a cylinder cover and a spacing duct, built according to the second way of carrying out the present invention, as schematically illustrated in FIG. 7 and in which the spacing duct is carried by the cylinder cover.
Figure 8A:
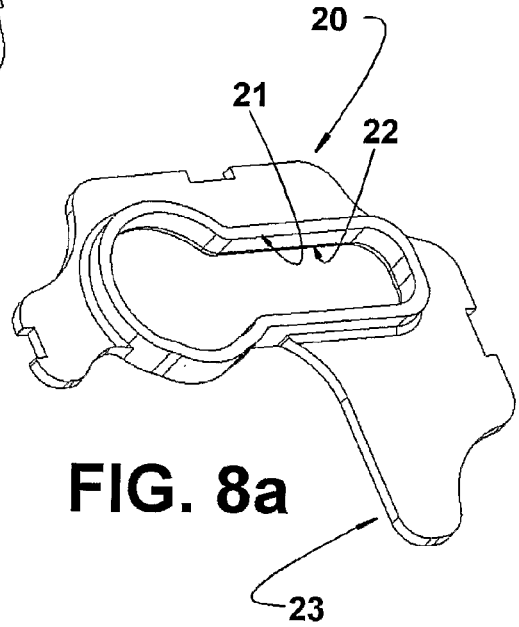
Figure 9:
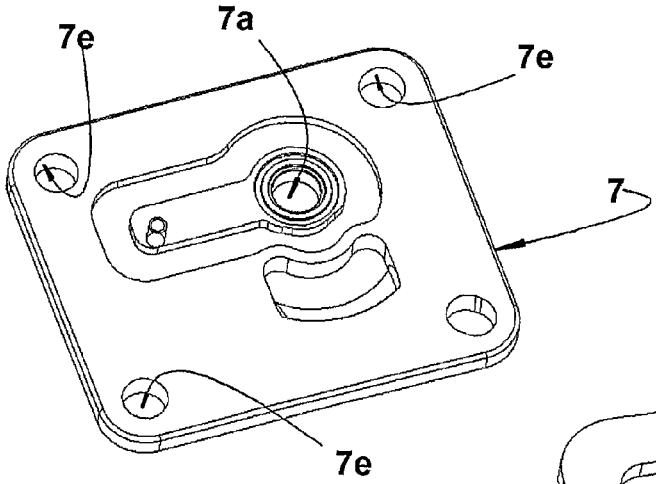
FIGS. 9 and 9*a* present, respectively and in a perspective view, a valve plate and a sealing gasket for mounting the cylinder cover and spacing duct of the present invention, as illustrated in FIGS. 8 and 8*a;*
Figure 9A:
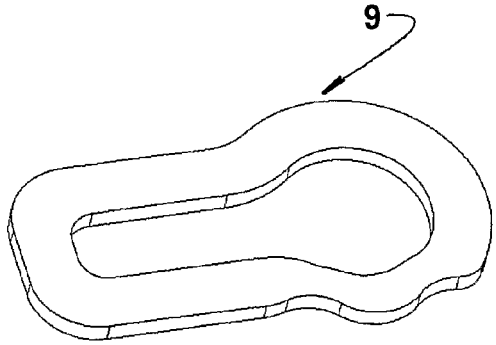
Figure 10:
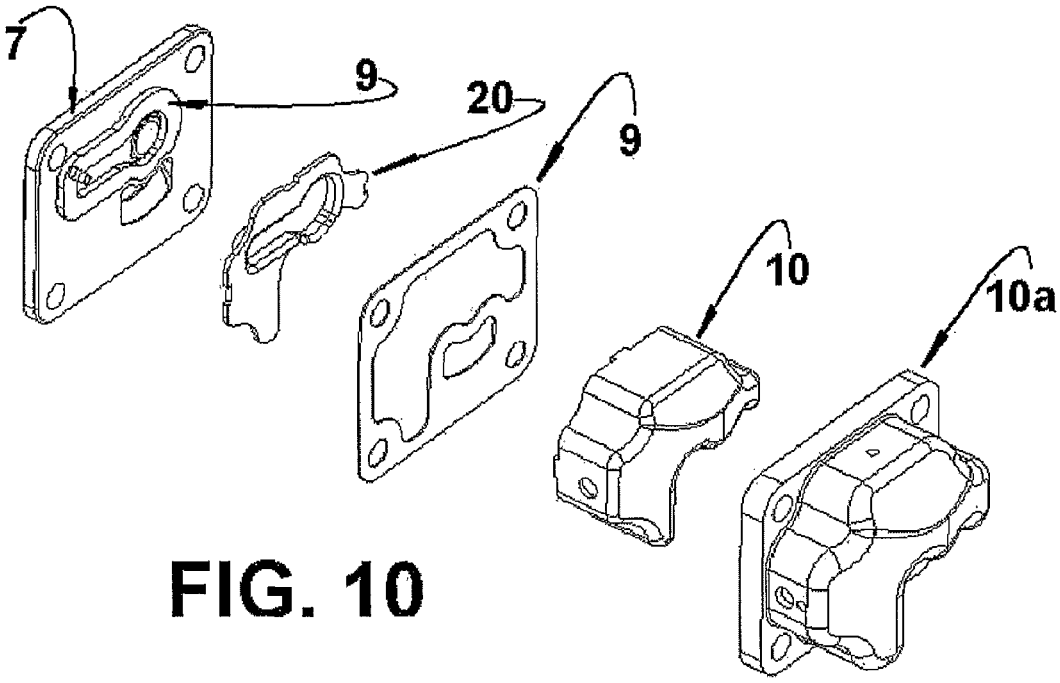
FIG. 10 is an exploded perspective view of a construction of valve plate, spacing duct and cylinder cover of the present invention, as illustrated in FIG. 7.

In a different embodiment of this construction, illustrated in FIGS. 7, 8 and 10, the peripheral flange 23 of the spacing duct 20 defines the entire front face 12 of the cylinder cover 10, being secured against the latter and also against the valve plate 7, by placing therebetween a respective sealing gasket 9. However, in the cases in which the cylinder cover 10 incorporates, in a single piece, the peripheral flange 23 of the spacing duct 20, the sealing gasket 9 is provided only between said spacing duct 20 and the valve plate 7.

In this embodiment is also foreseen the provision of an outer cover 10*a*, as illustrated in FIG. 10, located surrounding the cylinder cover 10 and allowing the fixation of the latter to the valve plate 7.

Figure 11:
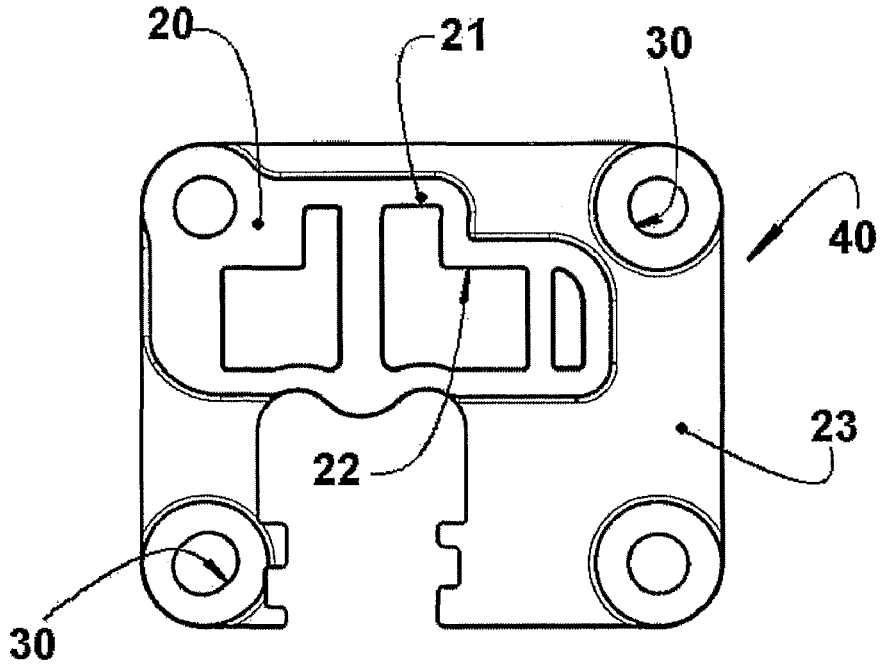
FIG. 11 is a front view of a different construction for the second embodiment of the invention, in which the spacing duct is carried by the cylinder cover, by mounting said spacing duct to an intermediate plate to be mounted to the cylinder cover.
Figure 12:
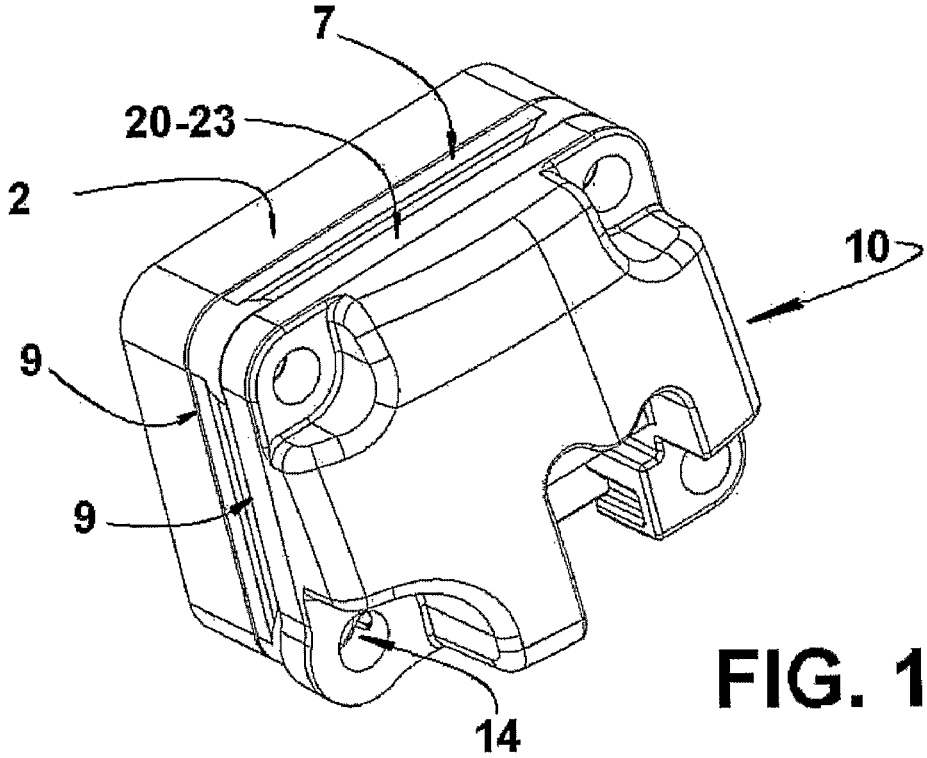
FIG. 12 is a perspective view of the cylinder cover and intermediate plate mounted to the valve plate, according to the embodiment of the present invention illustrated in FIG. 11.
Figure 13:
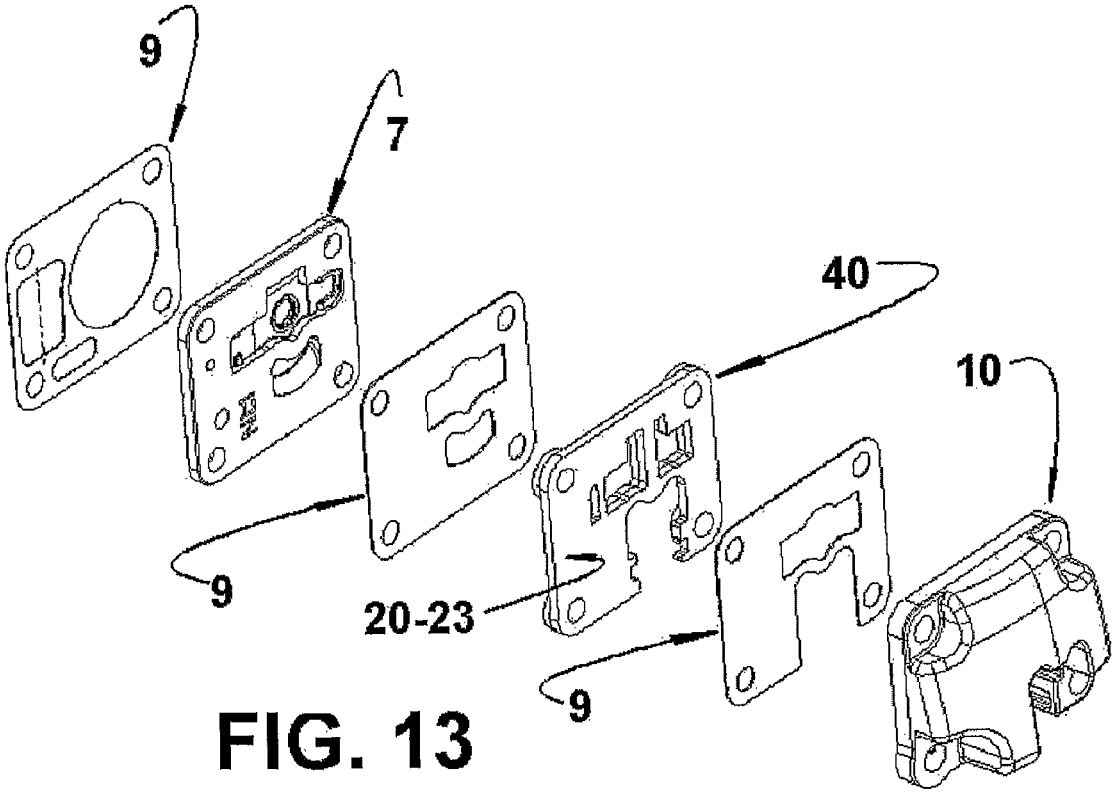
FIG. 13 is an exploded perspective view of the construction of the valve plate, spacing duct, cylinder cover and sealing gaskets of the present invention, as illustrated in FIGS. 11 and 12.

In another construction for the second embodiment of the present invention, illustrated in FIGS. 11 to 13, the peripheral flange 23 is defined by an intermediate plate 40 secured to the outlet end 22 of the spacing duct 20 by adequate means, such as welding, etc., defining the entire front face 12 of the cylinder cover 10. In this different construction, the intermediate plate 40 may be previously directly fixed to the spacing duct 20, without the placement of a sealing gasket 9 therebetween, and later be fixed to the cylinder cover 10, directly or with the use of a sealing gasket 9 therebetween, or also be previously fixed to the cylinder cover 10, before receiving the spacing duct 20.

In a constructive option, the intermediate plate 40 carries, or incorporates in a single piece, the tubular fixation spacers 30, as illustrated in FIG. 11, providing, upon mounting and securing of the cylinder cover 10 to the valve plate 7, a space between the latter and the intermediate plate 40.

In this assembly, the spacing duct 20 fixed to the intermediate plate 40 surrounds the discharge valve 8*a* region, creating a hermetic tubular region which guides the gas coming from the discharge orifice 7*a* to the inner region of the cylinder cover 10, defining the discharge chamber 11 therein. Thus, the discharge gas is retained in the volume provided by the cylinder cover 10 and intermediate plate 40, preventing the passage of the heat flow of this gas to the cylinder block 2, exactly due to the presence of the space between the intermediate plate 40 and the valve plate 7.

With the solution of the present invention, the reduction of the direct heat transfer from the discharge chamber 11 of the cylinder cover 10 to the already hot region of the cylinder block 2 allows reducing the temperatures in this region of the inside of the compressor, increasing the energy efficiency of the compression operation of the compressor.

Although only a few modes of carrying out the invention have been described and illustrated herein, it should be understood that modifications in the form and arrangement of the elements comprising the compressor may be effected, without departing from the inventive concept defined in the accompanying claims.

The invention claimed is:

1. A hermetic compressor with internal thermal insulation, comprising:

a housing (1) internally carrying a cylinder block (2) in which is defined a compression cylinder (3), having one end closed by a valve plate (7) provided with a discharge orifice (7*a*) and a suction orifice (7*b*), said valve plate (7) having a rear face 7*d*, facing cylinder block (2) and in which is mounted a suction valve (8*b*) and a front face (7*c*) against which is mounted a cylinder cover (5, 10) internally defining a discharge chamber (5*a*, 11) and in which the valve plate (7) externally carries a discharge valve (8*a*), characterized in that said compressor comprises a spacing duct (20) having one inlet end (21), hermetically mounted to the front face (7*c*) of the valve plate (7) and open to the discharge orifice (7*a*) of the valve plate (7) external to the suction orifice (7*b*) thereof, and an outlet end (22) hermetically mounted to the cylinder cover (10) and open to the interior of the discharge chamber (11), with the inlet end (21) of the spacing duct (20) presenting a cross-section area at least equal to that of the discharge orifice (7*a*), said spacing duct (20) defining a hermetic fluid communication between the interior of the compression cylinder (3) and the discharge chamber (11) through the discharge orifice (7*a*), said spacing duct (20) maintaining the cylinder cover (10) spaced from the valve plate (7) to provide an insulating chamber between said valve plate (7) and said cylinder cover (10) and by a value calculated so as to reduce the heat transfer from the gas in the discharge chamber to the valve plate (7) and defining, with the latter, an annular plenum around said spacing duct (20), the cross-section of the inlet end (21) of the spacing duct (20) circumscribing the discharge valve (8*a*).

2. The compressor, according to claim 1, characterized in that the discharge orifice (7*a*) is contained within the cross-sectional contour of the inlet end (21) of the spacing duct (20).

3. The compressor, according to claim 1, characterized in that the inlet and outlet ends (21, 22) of the spacing duct (20) are axially aligned with each other.

4. The compressor, according to claim 1, characterized in that the valve plate (7) incorporates in a single piece the inlet end (21) of the spacing duct (20).

5. The compressor, according to claim 1, characterized in that the spacing duct (20) carries, in the region of its outlet end, a peripheral flange (23) fixed against the cylinder cover (10) and defining a wall portion of the cylinder cover (10).

6. The compressor according to claim 5, characterized in that the peripheral flange (23) is incorporated in a single piece to the spacing duct (20).

7. The compressor, according to claim 6, characterized in that the peripheral flange (23) comprises an intermediate plate (40).

8. The compressor according to claim 5, characterized in that the peripheral flange (23) is fixed to the cylinder cover (10) in order to define a single piece with the cylinder cover.

9. The compressor, according to claim 5, characterized in that the spacing duct (20) is provided orthogonal to the plane of the valve plate (7).

10. The compressor, according to claim 9, characterized in that the spacing duct (20) is provided orthogonal to the wall portion defined by the peripheral flange (23).

11. The compressor, according to claim 1, characterized in that the spacing duct (20) is fixed to at least one of the parts of the cylinder cover (10) and the valve plate (7), with at least one sealing gasket (9) made of thermal insulating material being placed therebetween.

12. The compressor, according to claim 1, characterized in that the compressor comprises tubular fixation spacers (30) carried by one of the valve plate (7) or the cylinder cover (10), each of said tubular fixation spacer (30) being located in alignment with a fixation orifice (7*e*) defined on the valve plate (7) and aligned with a corresponding fixation hole (14) defined on the cylinder cover (10).

13. The compressor, according to claim 1, characterized in that the inlet end (21) and the outlet end (22) of the spacing duct (20) have the same cross-section.

14. The compressor, according to claim 13, characterized in that the spacing duct (20) has a constant cross-section between the inlet and outlet ends (21, 22) thereof.

15. The compressor, according to claim 13, characterized in that the spacing duct (20) has a constant cross-section along its length.

* * * * *